United States Patent [19]

Wiedijk et al.

[11] 4,101,799

[45] Jul. 18, 1978

[54] HIGH-PRESSURE GAS DISCHARGE LAMP

[75] Inventors: Piet Wiedijk; Johannes Hubertus Antonius Schmitz; Antonius Henricus Maria Van der Stap, all of Eindhoven, Netherlands

[73] Assignee: U.S. Philips Corporation, New York, N.Y.

[21] Appl. No.: 721,288

[22] Filed: Sep. 8, 1976

[30] Foreign Application Priority Data

Sep. 11, 1975 [NL] Netherlands ..... 7510691

[51] Int. Cl.[2] ..... H01J 5/50

[52] U.S. Cl. ..... 313/331; 252/520; 313/218; 313/311; 313/332

[58] Field of Search ..... 313/331, 332, 335, 217, 313/218, 311; 252/520, 507

[56] References Cited

U.S. PATENT DOCUMENTS

| | | | |
|---|---|---|---|
| 3,003,885 | 10/1961 | Mandorf, Jr. | 252/520 X |
| 3,363,133 | 1/1968 | Harris et al. | 313/318 X |
| 3,503,801 | 3/1970 | Huang et al. | 252/520 X |
| 3,705,112 | 12/1972 | Nienart | 252/520 |
| 3,915,900 | 10/1975 | Reinmuth et al. | 252/520 |
| 3,928,244 | 12/1975 | Passmore | 252/520 |
| 4,011,480 | 3/1977 | Jacobs et al. | 313/331 |

*Primary Examiner*—Saxfield Chatmon, Jr.
*Attorney, Agent, or Firm*—Frank R. Trifari; Robert S. Smith

[57] ABSTRACT

A high-pressure gas discharge lamp having a discharge vessel of aluminium oxide or yttrium oxide. Disposed within the discharge vessel is an electrode which is connected to a vacuum tight led-out current supply conductor which consists mainly of borides from the group consisting of titanium boride and zirconium boride.

7 Claims, 2 Drawing Figures

HIGH-PRESSURE GAS DISCHARGE LAMP

Figure 1:
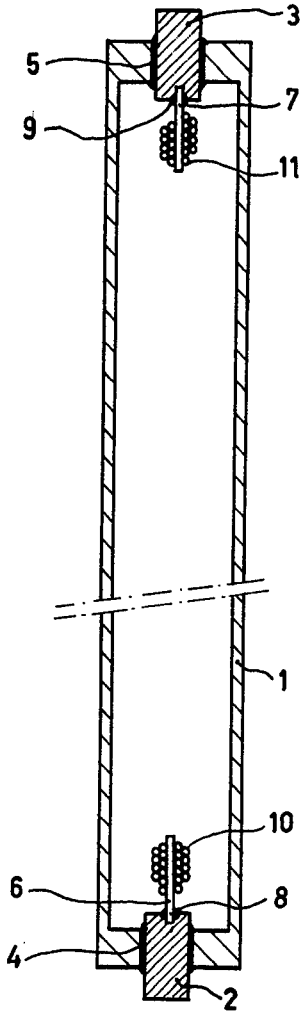

The invention relates to a high pressure gas discharge lamp having a discharge vessel whose wall consists mainly of at least one of the compounds aluminium oxide and yttrium oxide. Such lamps have been known for some time already. The use of the compounds aluminium oxide and yttrium oxide as material for the wall of high pressure discharge lamps has a number of important advantages. Namely, in the monocrystalline form and also in densely sintered form both materials are vacuum-tight and to a high degree transmissive of visible radiation. They can withstand very high temperatures so that lamps can be manufactured which in operation may be loaded thermally much higher than, for example, lamps made of quartz. An important advantage of these materials is that they are not corroded by agressive lamp fillings even at the high operating temperatures which occur.

If $Al_2O_3$ in densely sintered form is used the wall of the lamp generally contains 95% by weight or more of $Al_2O_3$. When $Y_2O_3$ in densely sintered form is used the wall of the lamp consists of at least 85% by weight of $Y_2O_3$. However, the $Y_2O_3$ is preferably used substantially pure.

The high-pressure sodium vapour discharge lamp is an embodiment of this type of lamp. A difficulty in such lamps relates to the current supply conductors which provide the current supply for the electrodes situated within the discharge vessel. So far niobium has generally been used as a material for the current supply conductors in high-pressure sodium vapour discharge lamps. Niobium is resistant to sodium and has a coefficient of expansion ($7.5 \times 10^{-6}K^{-1}$) which is substantially equal to that of aluminium oxide and which does not deviate much from that of yttrium oxide ($8.1 \times 10^{-6}K^{-1}$) so that a vacuum-tight connection to the wall of the discharge vessel is possible. A great drawback for using niobium as current supply conductor is the high price of this metal. Furthermore, the number of regions where niobium is mined is very limited so that a regular supply of the metal is not always ensured.

Molybdenum has been sometimes suggested as an alternative for niobium. However, the coefficient of expansion of molybdenum ($5.5 \times 10^{-6}K^{-1}$) deviates considerably from that of $Al_2O_3$ and $Y_2O_3$ so that in practice a great number of rejects occur in the production of lamps having a molybdenum current supply conductor and lamps are obtained whose life is unsatisfactory.

Another embodiment of the lamps of the present type contains a gas filling which comprises at least one metal halide. Namely with such halide discharge lamps which generally contain, in addition to halide also mercury and a rare gas, higher luminous fluxes in combination with a good colour reproduction can be obtained. So far one has been restricted to molybdenum for the current supply conductor for such lamps because niobium is not halide-resistant. The above-mentioned drawbacks of molybdenum are even still greater for these lamps. Namely, the current supply conductor is usually sealed into a lamp wall by means of a sealing glass. The suitable, halide-resistant sealing glasses which must be used for these lamps generally have a higher melting point than the sealing glasses which are used for the high-pressure sodium lamp. So for halide discharge lamps sealing in should be done at a higher temperature so that more mechanical stresses may be introduced and a higher percentage of rejects may occur.

It is an object of the invention to provide a high-pressure gas discharge lamp having a current conductor which does not show the drawbacks associated with the known supply conductors.

A high-pressure gas discharge lamp according to the invention comprises a discharge vessel whose wall consists mainly of at least one of the compounds aluminium oxide and yttrium oxide and which is provided with a gas filling in which the discharge takes place, while an electrode which is connected to a current supply conductor disposed within the discharge vessel and extending in vacuum tight relationship through said vessel. The lead through is characterized in that the current supply conductor mainly consists of at least one boride of titanium and/or zirconium.

It was found that titanium boride and zirconium boride, as well as titanium zirconium boride and mixtures of these borides have a sufficiently large electrical conductivity to enable their use as material for current supply conductors in discharge lamps. It was also found that these borides excellently satisfy the further requirements which must be made on the current supply conductor. They have a high melting point (3250 K for $TiB_2$ and 3310 K for $ZrB_2$) and a proper stability at a high temperature. At a temperature of, for example, 1500 K the borium pressure both over $TiB_2$ and over $ZrB_2$ is only $10^{-13}$ atm. At such a temperature the vapour pressure of the boride itself is even smaller than the borium pressure. A great advantage of the said borides is that the coefficient of expansion ($8.1 \times 10^{-6}K^{-1}$ for $TiB_2$ and $6.9 \times 10^{-6}K^{-1}$ for $ZrB_2$) fits in very well with that of aluminium oxide and that of yttrium oxide. Finally these borides excellently satisfy the requirements as regards chemical resistance. Also at high temperatures they are substantially not corroded by aluminium oxide, yttrium oxide, the usual sealing glasses and the lamp filling which may, for example, contain an alkaline metal such as sodium and/or metal halides.

Besides their suitability for use in halide-containing lamps the current supply conductors according to the invention also have the advantage with respect to the known niobium conductors that the raw materials necessary for producing these conductors are relatively cheap and not scarce.

Preference is given to lamps according to the invention having a current supply conductor made of titanium boride. This material appears to have the most suitable coefficient of expansion.

In a lamp according to the invention the current supply conductor may be part of the wall of the discharge vessel. This conductor may, for example, be constructed as a disc-shaped closure member, connected to the end of a cylindrical discharge vessel. However, preference is given to lamps according to the invention in which the current supply conductor is in the form of a pin or rod i.e. a solid cylindrical member which is fed through a part of the wall of the discharge vessel. The most reliable vacuum-tight seal with the discharge vessel is obtained with such pins or rods.

In an embodiment of a lamp according to the invention which is preferred the current supply conductor is sealed vacuum-tight to the wall of the discharge vessel by means of a sealing glass. With a suitable choice of the sealing glass any differences in expansion between conductor and discharge vessel can be compensated by this sealing glass.

In a further advantageous construction of a lamp according to the invention the current supply conductor is sealed vacuum-tight to the wall of the discharge vessel by means of a sintered seal. In such a lamp the conductor is directly sintered into a part of the wall of the discharge vessel and no sealing glasses need be used which might impose a restriction as regards the lamp filling.

The current supply conductors according to the invention of titanium boride and/or zirconium boride may be obtained by means of methods which are known per se, for example by hot press moulding or by isostatic hot press moulding (in which resistance or induction heating is applied) of pulverulent starting materials. See, for example, the publication by Nitzsche and Fickel in Tonindustrie-Zeitung, (96)(1972) number 1, pages 19 – 20. The product obtained in this manner may, if so desired, be further processed, for example by means of spark erosion to obtain the desired shape.

Figure 2:
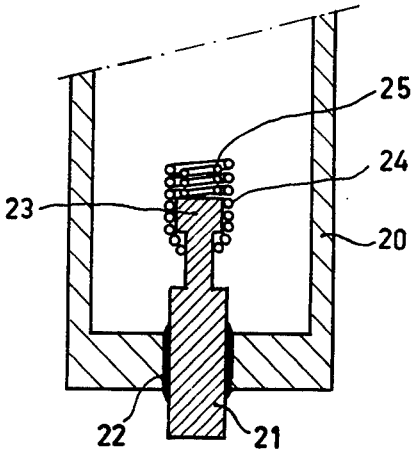

The invention will now be further explained with reference to a drawing in which:

FIG. 1 shows diagrammatically and in cross-section a high-pressure sodium vapour discharge lamp according to the invention and FIG. 2 shows also in cross-section the construction of the electrode and the current supply of a high-pressure metal halide lamp according to the invention.

FIG. 1 shows a high-pressure sodium vapour discharge lamp according to the invention. The lamp which consumes during operation a power of 1000 W comprises a discharge vessel 1 of densely sintered aluminium oxide having an outside diameter of approximately 13 mm and an inside diameter of approximately 11 mm. At the end of the discharge vessel current supply conductors 2 and 3 of titanium boride are sealed in by means of a sodium-resistant sealing glass (4 and 5 respectively). The supply conductors 2 and 3 consist of cylindrical rods having a diameter of 4 mm and a length of approximately 8 mm. At the ends of the titanium boride rods 2 and 3 which are situated within the discharge vessel an electrode pin 6 and 7 respectively made of tungsten is fastened in a central hole by means of titanium solder 8 and 9 respectively. The pins 6 and 7 are provided with wolfram tungsten double spirals 10 and 11 respectively which have an electron-emitting material between the turns. The distance between the electrodes 10 and 11 is approximately 15 cm. The discharge vessel 1 is provided with an amalgam which contains 50 mg of sodium and mercury and also contains xenon to a pressure of approximately 30 Torr. In general the lamp according to FIG. 1 is used in a glass outer bulb (not shown in the drawing). The light output of these lamps is substantially equal to that of comparable known lamps with a niobium supply conductor.

FIG. 2 shows the construction of the electrode and the supply conductor of a high-pressure metal halide lamp according to the invention. Reference 20 indicates the discharge vessel consisting of densely sintered aluminium oxide (outside diameter approximately 9 mm; inside diameter approximately 7.5 mm). A titanium boride rod 21 (diameter 2 mm) is sealed in at the end of the discharge vessel 20 by means of a halogen-resistance sealing glass 22. The part of the zirconium boride current supply 21 which is situated within the discharge vessel has a dumb-bell shaped end 23 to which a tungsten coil 24 is secured. A second tungsten coil 25 which is provided with an electron-emitting material is situated within the coil 24. The construction shown is, for example, suitable for a lamp which consumes in operation a power of 400 W and which has a filling consisting of mercury, argon and the iodides of sodium, thallium and indium.

What is claimed is:

1. A high-pressure gas discharge lamp which comprises a discharge vessel having a wall which consists mainly of at least one of the compounds selected from the group consisting of aluminium oxide and yttrium oxide, said vessel containing an ionizable gas filling, means for maintaining a gas discharge which includes at least one electrode and a current supply conductor connected thereto, said conductor being disposed within said discharge vessel and consisting mainly of at least one boride selected from the group of titanium boride and zirconium boride.

2. A high-pressure gas discharge lamp as claimed in claim 1 wherein said current supply conductor consists of titanium boride.

3. A high-pressure gas discharge lamp as claimed in claim 1 wherein said current supply conductor is a solid cylindrical member extending through a part of the wall of said discharge vessel.

4. A high-pressure gas discharge lamp as claimed in claim 1 wherein said current supply conductor is sealed vacuum tight to the wall of the discharge vessel by means of a sealing glass.

5. A high-pressure gas discharge lamp as claimed in claim 1 wherein said current supply conductor is sealed in a vacuum tight manner to said wall of said discharge vessel by means fo a sintered seal.

6. A high-pressure gas discharge lamp as claimed in claim 1 wherein said gas filling contains sodium.

7. A high-pressure gas discharge lamp as claimed in claim 1 wherein said gas filling contains at least one metal halide.

* * * * *